US005766059A

United States Patent [19]

Imai et al.

[11] Patent Number: 5,766,059

[45] Date of Patent: Jun. 16, 1998

[54] METHOD OF GRINDING A WORKPIECE

[75] Inventors: Tomoyasu Imai, Kariya; Masato Kitajima, Hekinan; Ryohei Mukai, Nagoya; Toshihiro Tsutsui, Nishio; Takayuki Yoshimi, Toyohashi, all of Japan

[73] Assignee: Toyoda Koki Kabushiki Kaisha, Kariya, Japan

[21] Appl. No.: 669,799

[22] Filed: Jun. 27, 1996

Related U.S. Application Data

[63] Continuation of Ser. No. 202,097, Feb. 25, 1994, abandoned.

[30] Foreign Application Priority Data

Feb. 26, 1993 [JP] Japan ..... 5-038439

[51] Int. Cl.[6] ..... B23B 25/00

[52] U.S. Cl. ..... 451/49; 451/51; 451/408; 451/242

[58] Field of Search ..... 451/49, 51, 54, 451/55, 406, 407, 408, 242, 244, 246, 140, 143, 181, 189, 209, 218, 397, 399, 398

[56] References Cited

U.S. PATENT DOCUMENTS

| | | | |
|---|---|---|---|
| 1,867,112 | 7/1932 | Steiner et al. | 451/408 |
| 2,141,596 | 12/1938 | Crompton, Jr. | 451/408 |
| 2,791,872 | 5/1957 | Wineka | 451/408 |
| 3,731,566 | 5/1973 | Kurimoto et al. | 451/408 |
| 3,743,490 | 7/1973 | Asano et al. | 451/408 |
| 4,179,854 | 12/1979 | Munekata et al. | 451/408 |
| 4,766,703 | 8/1988 | Rattazzini | 451/406 |
| 5,213,348 | 5/1993 | Crossman et al. | 451/407 |
| 5,303,512 | 4/1994 | Tsujiuchi et al. . | |

FOREIGN PATENT DOCUMENTS 0 551 630 7/1993 European Pat. Off. .

*Primary Examiner*—Eileen Morgan

*Attorney, Agent, or Firm*—Oblon, Spivak, McClelland, Maier & Neustadt, P.C.

[57] ABSTRACT

A workpiece and a grinding wheel are rotated and the grinding wheel is moved in a direction parallel to the rotational axis of the workplace so as to grind a cylindrical surface of the workpiece. After a part of the cylindrical surface is ground, a rest device is advanced towards the workpiece so as to support the part of the cylindrical surface of the workpiece which has been ground. Under the condition, the remaining portion of the cylindrical surface of the workpiece is ground.

4 Claims, 5 Drawing Sheets

MEMORY
CPU
INTERFACE
DUX
DUZ
INTERFACE
INTER-FACE
SEQUENCE CONTROLLER
X
Z
W
G
10
11
13
13a
14
14a
15
16
17
18
21
22
23
24
25
26
30
31
32
33
34
40
50
51
52
53
54
55
60
61

METHOD OF GRINDING A WORKPIECE

This application is a continuation of application Ser. No. 08/202,097, filed on Feb. 25, 1994, now abandoned.

BACKGROUND OF THE INVENTION

1. Field of the Invention

The present invention relates to a method of grinding an outer surface of a cylindrical workpiece by relatively moving a grinding wheel in a direction parallel to the rotational axis of the workpiece, with the workpiece and grinding wheel being rotated.

2. Discussion of the Prior Art

In grinding a workpiece having first and second cylindrical portions and a shoulder portion therebetween, a grinding wheel is relatively moved in a direction parallel to the rotational axis of the workpiece with the grinding wheel and the workpiece being rotated, so as to grind the outer surface of the first cylindrical portion of the workpiece. Subsequently, the grinding wheel is advanced radially inwardly of the workplace and is again relatively moved in the direction parallel to the rotational axis of the workplace so as to grind the outer surface of the second cylindrical surface of the workpiece. Since the diameter of the second cylindrical portion is smaller than that of the first cylindrical portion, the rigidity of the same is small. Also, the second cylindrical portion adjacent to the first cylindrical portion is remote from positions at which the workpiece is supported by a headstock and a tailstock. For these reasons, during a plunge grinding on the second cylindrical portion adjacent to the first cylindrical portion, the workpiece is bent due to the grinding force and an actual grinding amount by the grinding wheel on the workpiece is reduced, whereby chatter marks are created on the second cylindrical portion adjacent to the first cylindrical portion. To overcome the above-mentioned problems, a method may be conceived of wherein the outer surface of the cylindrical workpiece to be ground is kept supported by a rest device during the grinding operation. However, the method involves a drawback that the flexing of the workplace is reduced after the portion of the workpiece supported by the rest device is ground, whereby the grinding amount on a portion of the workplace at one side of the rest device differs from that on the other portion of the workpiece at the other side of the rest device, thereby resulting in the deterioration of straightness of the workpiece.

SUMMARY OF THE INVENTIION

Accordingly, it is an object of the present invention to provide an improved method capable of grinding a workpiece without creating chatter marks on a ground surface even where the rigidity of the workpiece is small.

Another object of the present invention is to provide an improved method capable of efficiently grinding a stepped workpiece of a relatively small rigidity with desired surface accuracy and straightness.

Briefly, in accordance with the present invention, there is provided a method of grinding a cylindrical surface of a cylindrical workpiece with a grinding wheel. The method comprises the steps of rotating the workpiece and the grinding wheel, grinding a part of the cylindrical surface of the workpiece, advancing a rest device towards the workpiece so as to support the part having been ground of the cylindrical surface of the workpiece, and grinding the remaining portion of the cylindrical surface of the workpiece.

With this configuration, when the remaining portion of the workpiece is ground, the rest device supports the portion of the workpiece on which a grinding operation has been completed. Therefore, it can be avoided that the actual grinding amount of the remaining portion is decreased due to the flexing of the workpiece and that hence, chatter marks are created on the remaining portion.

In another aspect of the present invention, the workpiece takes a stepped shape having at least two cylindrical portions. After a grinding on a first cylindrical portion is completed, the rest device is advanced so as to support the first cylindrical portion adjacent to a second cylindrical portion, and a plunge grinding is then carried out on the second cylindrical portion. Since the plunge grinding on the second cylindrical portion is performed with the already ground first cylindrical portion being supported by the rest device, chatter marks can be prevented from being created on the second cylindrical portion adjacent to the first cylindrical portion.

BRIEF DESCRIPTION OF THE ACCOMPANYING DRAWINGS

Various other objects, features and many of the attendant advantages of the present invention will be readily appreciated as the same becomes better understood by reference to the following detailed description of a preferred embodiment when considered in connection with the accompanying drawings, in which.

Figure 4:
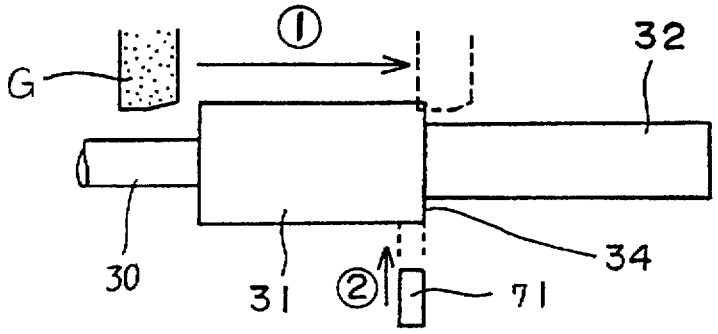
Figure 4:
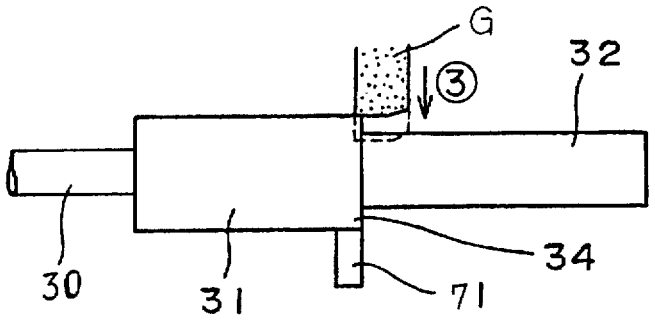
Figure 4:
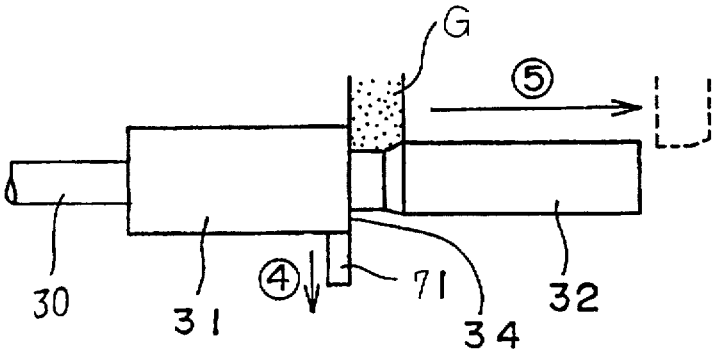
Figure 5:
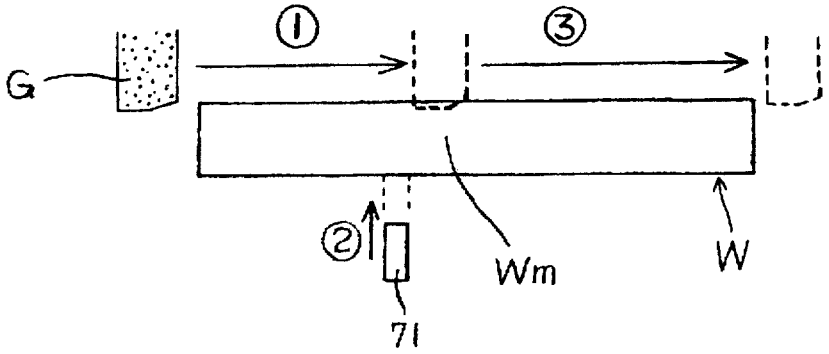

FIGS. 4(*a*)–4(*c*) are explanatory views showing the movements of a grinding wheel and a work rest shoe of the rest device relative to a workpiece in grinding operation for the workpiece having a shoulder portion; and FIG. 5 is an explanatory view showing the movements of a grinding wheel and a work rest shoe of the rest device relative to a workpiece in grinding operation for workpiece having a straight portion.

DETAILED DESCRIPTION OF THE PREFRERRED EMBODIMENT

Figure 1:
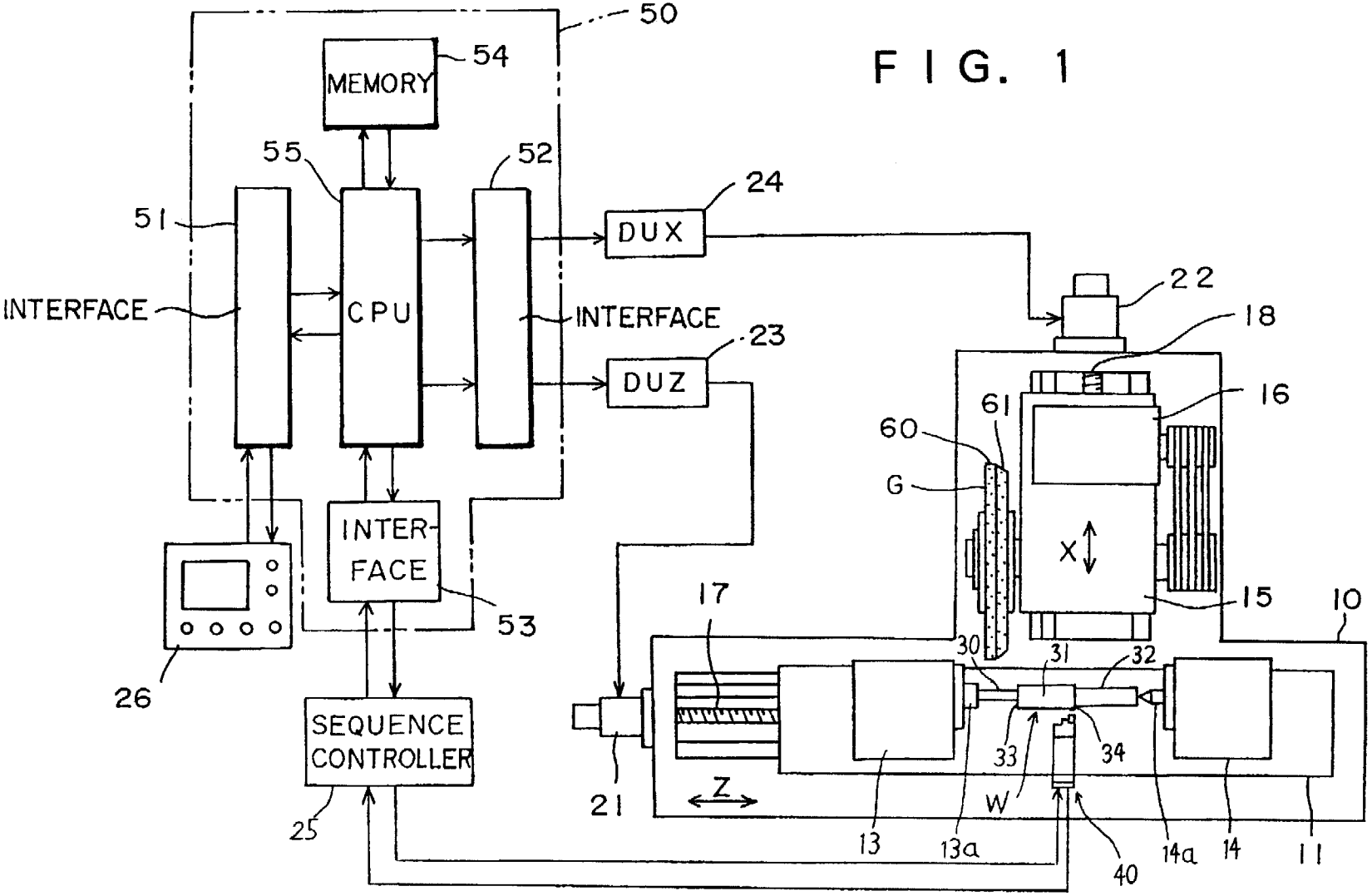
FIG. 1 is a plan view of a numerically controlled cylindrical grinding machine according to the present invention, also illustrating a block diagram of an electric control system therefor.

Referring now to the drawings and particularly to FIG. 1 thereof, there is shown a numerically controlled grinding machine having a bed 10, on which a table 11 is mounted. This table 11 is connected to a servomotor 21 via a feed screw mechanism 17 so as to be moved in a Z-axis direction. A headstock 13 and a tailstock 14 are disposed on the table 11 in opposite relation to each other and are provided with a chuck 13*a* and a center 14*a*, respectively. A stepped workpiece W is held at both ends by the chuck 13 and center 14*a* in such a way that the workpiece W can be rotated about an axis parallel to the Z-axis direction in which the table 11 is moved, and is rotated by a spindle motor (not shown) incorporated in the headstock 13. Disposed on the table 11 is a rest device 40 movable in a radial direction of the workpiece W.

A grinding wheel head 15 is mounted at the top rear of the bed 10 and is connected to a servomotor 22 via a feed screw mechanism 18 so as to be moved by the servomotor 22 in an X-axis direction that is perpendicular to the Z-axis direction. A grinding wheel G is supported on the wheel head 15 and is rotated about an axis parallel to the Z-axis direction by a motor 16 through pulleys and belts. The grinding wheel G has a straight grinding surface 60 and a tapered grinding surface 61 successive thereto. The straight grinding surface 60 extends parallel to the rotational axis of the workpiece W, while the tapered grinding surface 61 extends inclined at acute angle with respect to the rotational axis of the workpiece W.

A numeral 50 denotes a numerical controller which is composed of a central processing unit 55 (referred to as "CPU" hereinafter), a memory 54 and interfaces 51, 52, 53. An operator's panel 26 is connected to the CPU 55 through the interface 51. Drive circuits 23 and 24 are also connected to the CPU 55 through the interface 52 to drive the servomotors 21 and 22, respectively. The rest device 40 is connected to the CPU 55 through the interface 53 and a sequence controller 25. A grinding program is stored in the memory 54.

The workpiece W has a small-diameter portion 30, a first cylindrical portion 31 and a second cylindrical portion 32. A first shoulder portion 33 is formed between the small-diameter portion 30 and first cylindrical portion 31, and a second shoulder portion 34 is formed between the first and second cylindrical portions 31 and 32. The diameters of the first cylindrical portion 31, second cylindrical portion 32 and small-diameter portion 30 becomes small in that order. The small-diameter portion 30 of the workplace W is held by the chuck 13*a*.

Figure 2:
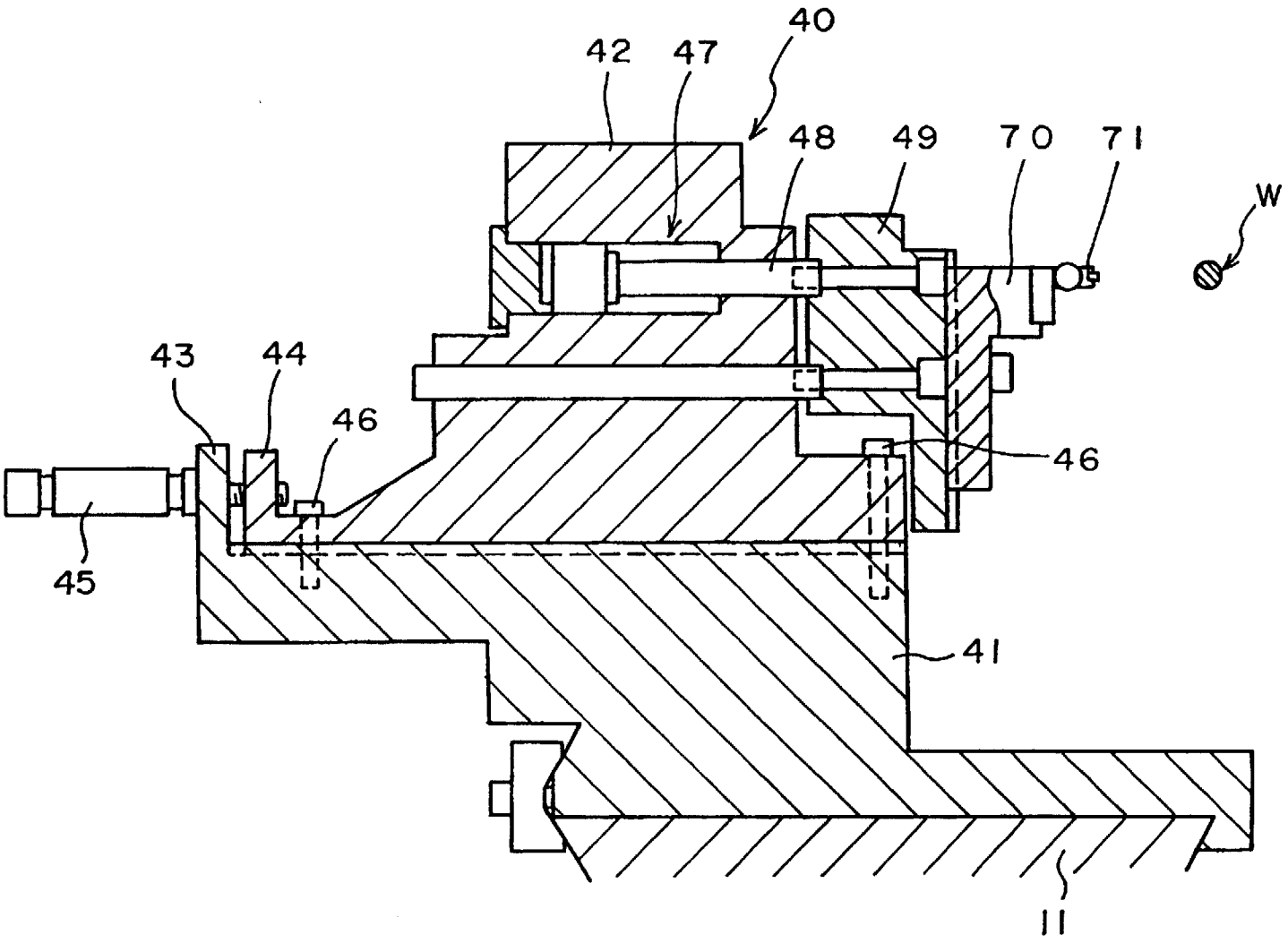
FIG. 2 is an enlarged sectional view of a rest device shown in FIG. 1.

On the table 11, the rest device 40 shown in FIG. 2 in detail is disposed to be opposite to the grinding wheel G with the workpiece W therebetween. The rest device 40 is provided with a guide table 41 fixed to the table 11 and a body 42 mounted on the guide table 41. The guide table 41 and body 42 are formed with first and second second flange portions 43 and 44, respectively. A screw shaft 45 is rotatably supported by the first flange portion 43 and one end thereof is engaged with the second flange portion 44. The position of the body 42 in the radial direction of the workplace W is adjusted by turning the screw shaft 45. At a suitable position, the body 42 is fixed by means of bolts 46 to the guide table 41. The body 42 is formed with a cylinder device 47 in which a piston 48 is fitted to be movable in the radial direction of the workpiece W. An attachment member 49 is coupled to one end of the piston 48. A setting table 70, which can be adjusted in the vertical direction, is secured to the attachment member 49. A work rest shoe 71 is detachably fixed to the setting table 70. The work rest shoe 71 is positioned to face the first cylindrical portion 31 adjacent to the second cylindrical portion 32 and is advanced by the cylinder device 47 along with the attachment member 49 and the setting table 70 to support the first cylindrical portion 31 against the grinding wheel G.

Figure 3:
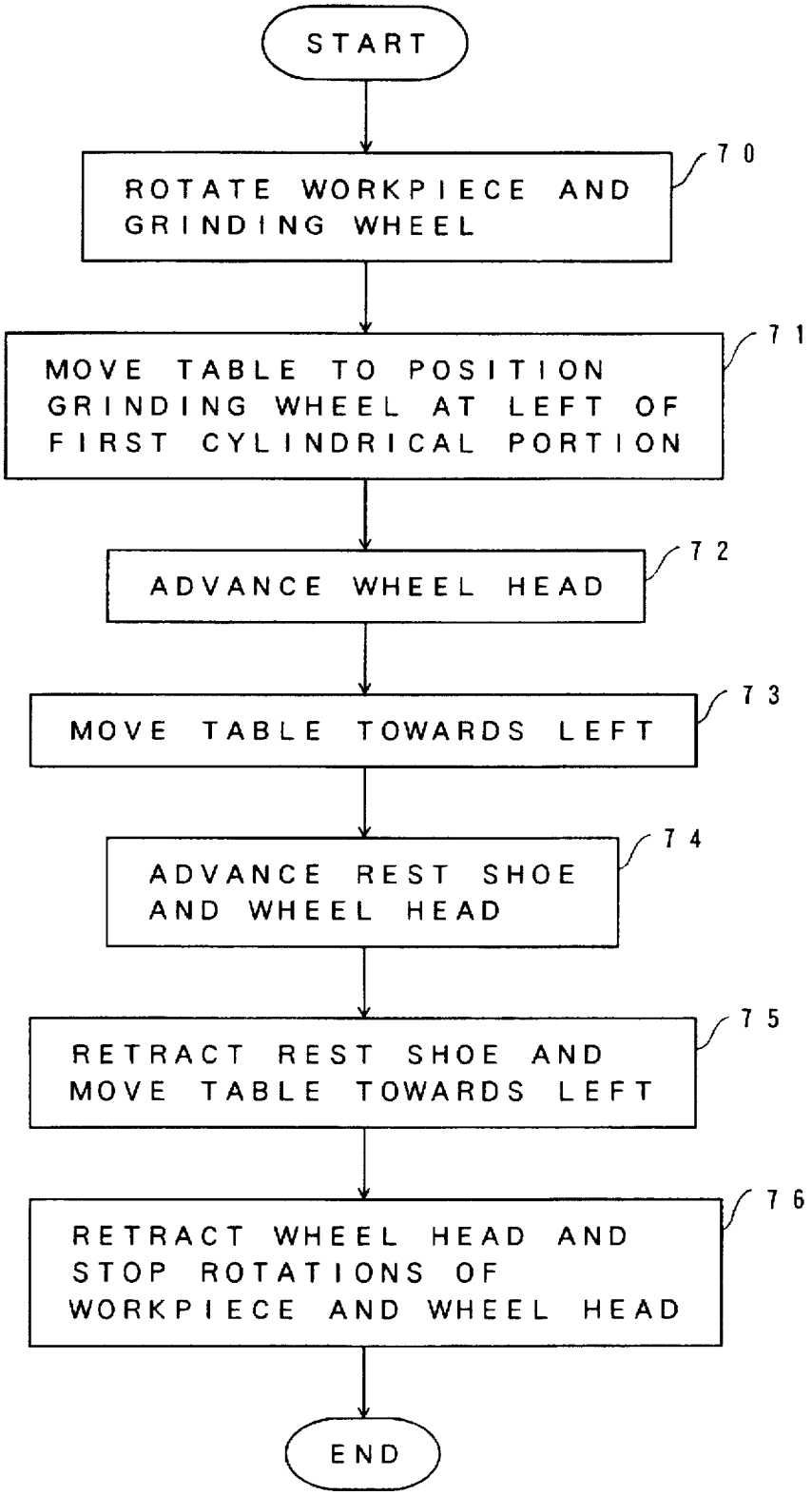
FIG. 3 is a flowchart illustrating in detail a grinding program executed by a CPU, illustrated in FIG. 1.

A grinding operation of the grinding machine constructed above will now be described with reference to FIG. 3 and 4(*a*)–4(*c*). With the workpiece W being set between headstock 13 and tailstock 14, when the operator pushes a grinding start button (not numbered) on the operator's panel 26, a grinding program stored in the memory 54 is executed. FIG. 3 is a flowchart of a grinding program for controlling a grinding operation. At first step 70, the workpiece W and grinding wheel G are rotated. At next step 71, the table 11 is moved to that position where the grinding wheel G faces the right end of the small-diameter portion 30 of the workpiece W, as indicated by the solid line in FIG. 4(*a*). The wheel head 15 is then advanced until the grinding wheel G is given a programmed infeed against the first cylindrical portion 31 of the workplace W, at step 72. After that, at step 73, the table 11 is traversed towards the left in FIG. 1 (the arrow ① in FIG. 4(*a*)). During this operation, the tapered grinding surface 61 carries out a rough grinding on the outer surface of the first cylindrical portion 31, at the same time of which the straight grinding surface 60 carries out a fine grinding on the roughly ground outer surface. Thus, the grinding on the outer cylindrical surface of the first cylindrical portion 31 can be completed by traversing the table 11 only once.

Subsequently, the process proceeds to step 74, at which the work rest shoe 71 is advanced radially of the workpiece W so as to support the right end of the first cylindrical portion 31 adjacent to the second cylindrical portion 32 (the arrow ② in FIG. 4(*a*)), and the wheel head 20 is then advanced to effect a shoulder grinding on the second shoulder portion 34 and a plunge grinding on the left end of the second cylindrical portion 32 (the arrow ③ in FIG. 4(*b*)). Since the advanced end of the work rest shoe 71 is determined based upon the finish diameter of the first cylindrical portion 31 on which the traverse grinding has been completed, it can be avoided that the workpiece W is extremely bent towards the grinding wheel G to excessively grind the workpiece W because of the advancement of the work rest shoe 71. Before the plunge grinding on the second cylindrical portion 32 is started, the work rest shoe 71 has been moved to its advance end, as shown in FIG. 4(*b*). Therefore, the actual grinding amount by the grinding wheel G on the workplace W is kept as programmed because the workpiece W is not bent away from the grinding wheel G, whereby it can be avoided that chatter marks are created on the second cylindrical portion 32.

Upon completion of the plunge grinding on the second cylindrical portion 32, the process proceeds to step 75 at which the work rest shoe 71 is retracted (the arrow ④ in FIG. 4(*c*)) and then, the table 11 is further moved towards the left as viewed in FIG. 1 (the arrow ⑤ in FIG. 4(*c*)). Like the grinding on the first cylindrical portion 31, the grinding on the outer cylindrical surface of the second cylindrical portion 32 is completed by traversing the table 11 only once. When the traverse grinding on the second cylindrical portion 32 is completed, the wheel head 15 is retracted at step 76. At the same time, the rotations of the workpiece W and grinding wheel G are stopped and the grinding operation on the workplece W is terminated.

Although the grinding wheel G in the aforementioned embodiment has tapered and straight grinding surfaces 61, 60 for grinding the outer cylindrical surfaces 31, 32 through only one traverse food of the table 11, a grinding wheel G having a straight grinding surface only may be used in the grinding machine.

In the embodiment, the work rest shoe 71 is retracted prior to the traverse grinding on the second cylindrical portion 32 for preventing chatter marks from being created thereon. However, it may not be necessary for the work rest shoe 71 to be retracted prior to the traverse grinding on the second cylindrical portion 32.

In the case where the shoulder grinding on the second shoulder portion 34 is not carried out and where the plunge feed of the wheel head 15 is controlled by measuring the diameter of the second cylindrical portion 32 adjacent to the first cylindrical portion 31, the advance speed of the wheel head 15 has to be slow for size control. This results in creating chatter marks during the plunge grinding on the second cylindrical portion 32. However, using the rest device 40 in the same manner as the foregoing shoulder grinding enables the workplace W to be ground without creating chatter marks thereon.

The present invention can be applied not only to a workpiece having a shoulder portion but also to one having a straight portion. In this case, as shown in FIG. 5, a grinding wheel G is relatively moved in a direction parallel to the rotational axis of the workpiece W (the arrow ① in FIG. 5). Since the middle portion Wm in the longitudinal direction of the workpiece W is remote from the supporting positions of the headstock 13 and tailstock 14, the rigidity of the workpiece W at the middle portion Wm is small, and therefore, chatter marks would be created on the middle portion Wm. Therefore, when the grinding on the outer surface of the cylindrical workpiece W is completed up to an approximately middle portion Wm, the traverse feed is halted and the work rest shoe 71 is advanced so as to support the portion of the workpiece W which has been ground (the arrow ② in FIG. 5). Under such condition, the grinding wheel G is again relatively moved in the direction parallel to the rotational axis of the workpiece so that the outer cylindrical surface of the remaining portion is ground (the arrow ③ in FIG. 5).

Obviously, numerous modifications and variations of the present invention are possible in light of the above teachings. It is therefore to be understood that within the scope of the appended claims, the present invention may be practiced otherwise than as specifically described herein.

What is claimed is:

1. A method of grinding a workpiece with a grinding wheel, comprising the steps of:

rotating the workpiece and the grinding wheel;

moving the grinding wheel, in a direction parallel to the axis of the workpiece, relative to the workpiece and to a rest device so as to grind a part of the outer surface of the workpiece without supporting the workpiece using the rest device, the workpiece and the rest device to be moved together in said direction relative to the grinding wheel;

advancing the rest device towards the workpiece so as to support the part of the outer surface of the workpiece which part has been ground; and moving the grinding wheel, in said direction, relative to the workpiece and to the rest device supporting the workpiece so as to grind the remaining portion of the outer surface of the workpiece while maintaining a positional relationship between the workpiece and the rest device in said direction.

2. A method of grinding a workpiece as set forth in claim 1, wherein the rest device is advanced to support the part of the outer surface of the workpiece at a position adjacent to the remaining portion.

3. A method of grinding a workpiece with a grinding wheel wherein the workpiece includes at least a first cylindrical portion and a second cylindrical portion having a diameter smaller than the first cylindrical portion, the method comprising the steps of:

rotating the workpiece and the grinding wheel;

moving the grinding wheel, in a direction parallel to the axis of the workpiece, relative to the workpiece and to a rest device so as to grind an outer surface of the first cylindrical portion of the workpiece without supporting the workpiece using the rest device, the workpiece and the rest device to be moved together in said direction relative to the grinding wheel;

advancing the grinding wheel towards the workpiece so as to carry out a plunge grinding on the second cylindrical portion; and moving the grinding wheel, in said direction, relative to the workpiece and to the rest device supporting the workpiece so as grind an outer surface of the second cylindrical portion of the workpiece.

4. A method of grinding a workpiece as set forth in claim 3, wherein the rest device is advance to support the first cylindrical portion of the workpiece at a position adjacent to the second cylindrical portion.

* * * * *